United States Patent [19]

Nagata

[11] Patent Number: 4,811,902

[45] Date of Patent: Mar. 14, 1989

[54] SUPERHIGH PRESSURE FLUID INJECTION APPARATUS

[75] Inventor: Yukiaki Nagata, Uozu, Japan

[73] Assignee: Kabushiki Kaisha Sugino Machine, Uozu, Japan

[21] Appl. No.: 49,729

[22] Filed: May 12, 1987

[30] Foreign Application Priority Data

May 13, 1986 [JP] Japan ..... 61-110089

[51] Int. Cl.[4] ..... B05B 3/04

[52] U.S. Cl. ..... 239/240; 239/381; 239/263.3; 134/181; 415/35

[58] Field of Search ..... 239/225.1, 237, 240, 239/380, 381, 382, 383, 263, 263.3, 264; 134/181; 415/122 R, 122 A, 202, 35

[56] References Cited

U.S. PATENT DOCUMENTS

| | | | |
|---|---|---|---|
| 1,035,082 | 8/1912 | Cachin | 415/35 |
| 3,934,820 | 1/1976 | Phaup | 239/240 |
| 4,221,336 | 9/1980 | Diamond | 239/428.5 |
| 4,369,850 | 1/1983 | Barker | 239/264 |
| 4,376,443 | 3/1983 | Mondy, Jr. | 134/181 |
| 4,501,391 | 2/1985 | Hunter | 239/240 |
| 4,613,077 | 9/1986 | Aronson | 239/240 |
| 4,659,018 | 4/1987 | Shulman | 239/225.1 |
| 4,732,325 | 3/1988 | Jensen et al. | 239/381 |

FOREIGN PATENT DOCUMENTS

| | | |
|---|---|---|
| 57-22692 | 5/1982 | Japan . |
| 57-81100 | 5/1982 | Japan . |
| 59-120250 | 8/1984 | Japan . |
| 59-120251 | 8/1984 | Japan . |

OTHER PUBLICATIONS

Alan Osbourne, Modern Marine Engineer's Manual, vol. 1, 1965, pp. 12-60 to 12-61.

*Primary Examiner*—Andres Kashnikow
*Assistant Examiner*—Christopher G. Trainor
*Attorney, Agent, or Firm*—Michael N. Meller

[57] ABSTRACT

A superhigh pressure fluid injection apparatus causes a fine jet streamline flow of superhigh pressure fluid to make a circular motion by utilizing a part of the supplied high pressure fluid. The apparatus includes an eccentric rotary member (3) for eccentrically rotating a nozzle (5), and a hydraulic motor (2) for driving the rotary member (3) into rotation by utilizing a part of the supplied high pressure fluid to the nozzle (5).

4 Claims, 4 Drawing Sheets

SUPERHIGH PRESSURE FLUID INJECTION APPARATUS

BACKGROUND OF THE INVENTION

The present invention relates to an apparatus for discharging a jet of superhigh pressure fluid to utilize the jet energy of the fluid for various processing purposes, and more particularly to a streamline flow transfer apparatus for effectively applying the fine jet streamline flow of a superhigh pressure fluid to the processing of workpieces.

DESCRIPTION OF THE PRIOR ART

In the past, it has not been infrequent that when applying a superhigh pressure fluid for many different processing purposes, the fluid discharged from a nozzle is formed into a very fine streamline flow of less than 1 mm. In other words, it is designed so that a superhigh pressure acts on the fine streamline flow to increase its energy density and the streamline flow is applied to the processing of a workpiece.

While the processing method utilizing a jet of superhigh pressure fluid has the advantage of the reduced processing allowance due to the extremely fine streamline flow as mentioned previously, it is difficult to apply the superhigh pressure fluid to a workpiece having a wide area.

Under these circumstances, attempts have been made to overcome the foregoing difficulty by causing the streamline flow to be movable. Such an attempt is seen in Japanese Patent Publication No. 57-22692 and a superhigh pressure fluid can be effectively applied to the wide area of a workpiece. Such attempts are also seen in Japanese Utility Model Laid-Open No. 57-81100, No. 59-120250, No. 59-120251, etc.

Then, these prior art apparatus are generally so constructed that in order to cause the jet of fluid to move in a circular manner, a nozzle mounting pipe is supported at a position eccentric with the center of rotation of a rotary member and the rotary member is driven into rotation by a driver such as an air motor or electric motor to cause the nozzle mounting pipe to make a circular motion corresponding to the amount of eccentricity, thus causing the jet of superhigh pressure fluid discharged from the nozzle to make a circular jet path and thereby making it possible to apply the jet of superhigh pressure fluid to the processing of a workpiece having a wide area.

These prior art apparatus are common in that the nozzle is caused to make a circular motion to continuously apply the superhigh pressure fluid as an area and that the power of an electric motor, air motor or the like is utilized as the driving mechanism for moving the nozzle in a circular manner.

In other words, since the superhigh pressure fluid for processing purposes and another medium serving as the driving mechanism exist together in the prior art apparatus, particularly where the driving medium is electricity, there is the danger of causing an electric leakage and electric shock due to the fact that the enviroment of its application involves the use of water. Also, where the driving medium is the air motor, the apparatus must be supplied with the superhigh pressure fluid and pressurized air and the operating performance tends to deteriorate due to the installation of the two different pipes.

SUMMARY OF THE INVENTION

In view of the foregoing prior art apparatus, it is the primary object of the present invention to provide a superhigh pressure fluid injection apparatus which ensures an improved operating performance and a simplified equipment due to the unification of component parts.

To accomplish the above object, in accordance with the invention there is thus provided a superhigh pressure fluid injection apparatus including a pipe shaft having a nozzle arranged at one end and connected to a superhigh pressure producer at the other end, rotary driving means actuated by pressurized air, an eccentric rotating member adapted to be driven into rotation by the driving means and relatively rotatably supporting the pipe shaft at a position eccentric by a given distance with the center of rotation, and flow passage means branched at a given position of the pipe shaft to introduce the pressurized fluid into the driving means.

In accordance with its illustrated specific embodiments, the driving means is fixedly mounted on the pipe shaft, the driving means includes a first nozzle for discharging the superhigh pressure fluid branched from the pipe shaft within the fluid flow passage means, an air-fluid mixing chamber for mixing air with the jet of fluid from the first nozzle at a position downstream of the first nozzle, a second nozzle being arranged downstream of the air-fluid mixing chamber for covering and discharging the air-fluid mixture and a turbine being rotatably arranged to oppose the fluid discharged from the second nozzle, the driving means is provided with a member disposed within the fluid flow passage means to agitate the flow of the fluid supplied to the driving means or the driving means is provided with a member for adjusting the rotation speed of the turbine.

In accordance with the invention, by virtue of the fact that the same fluid which is jetted from the nozzle for cleaning and other processing purposes is used as the medium for driving the apparatus and this fluid is branched for use from the pipe shaft within the apparatus, only the single pipeline is needed for supplying the medium so that the operation of the apparatus is not impeded in any way and the apparatus can be operated very easily, thereby improving the operating performance. Also, since only one kind of fluid is supplied to the apparatus, only one producing means is required for producing the fluid and the equipment is simplified through the utilization of the component parts.

In addition, the details of the apparatus show that the fluid discharged against the turbine is mixed with air so as to minimize damage to the turbine due to the impact of fluid thereon and the two-stage nozzle construction has the effect of ensuring the effective mixing of air. Further, the arrangement of the agitating nozzle further facilitates the mixing of air and the prevention of damage to the turbine is effected more effectively.

The above and other objects as well as advantageous features of the invention will become clearer from the following description taken in conjunction with the drawings.

DESCRIPTION OF THE PREFERRED EMBODIMENTS

Figure 1:
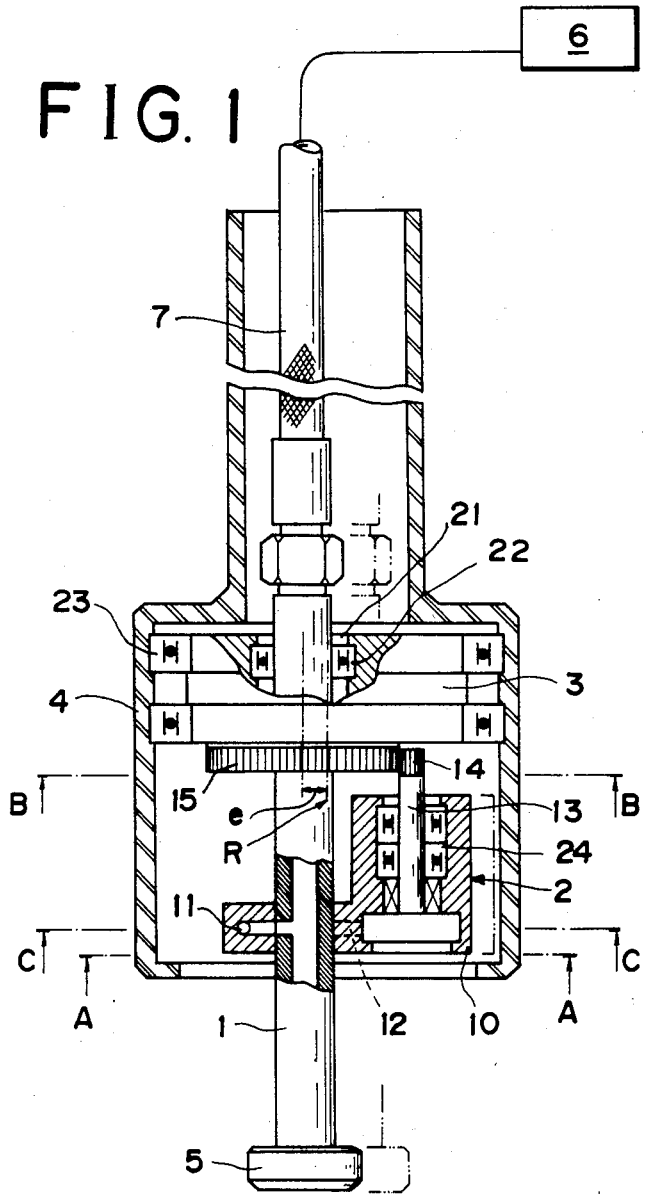
FIG. 1 is a longitudinal sectional side view showing a basic construction of the present invention.
Figure 2:
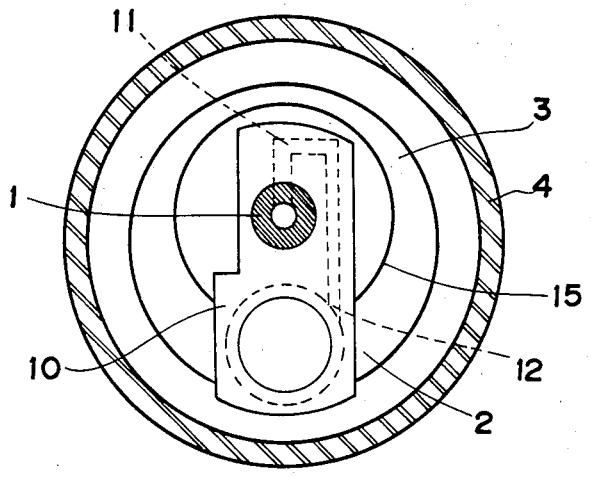
FIGS. 2 and 3 are respective sectional views taken along the lines A—A and B—B of FIG. 1.
Figure 3:
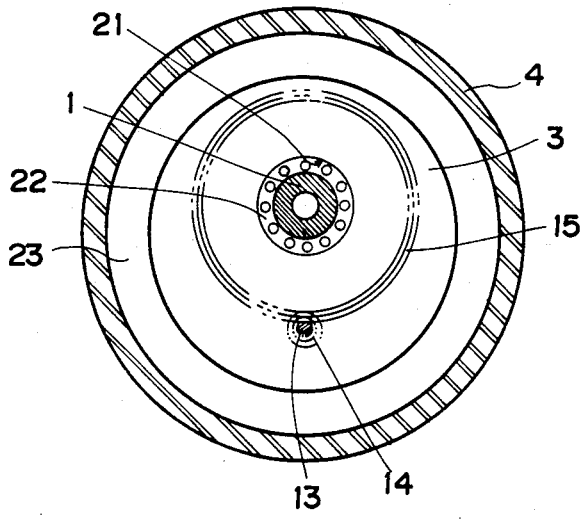

Referring to FIG. 1 illustrating a longitudinal sectional side view showing a basic construction of the invention, numeral 1 designates a pipe shaft, and 2 designates driving means, more particularly a hydraulic motor using water as its working fluid. Numeral 3 designates an eccentric rotary member including an eccentric hole 21 formed at a position eccentric by a distance e with its center of rotation R and relatively rotatably receiving the pipe shaft 1 through a bearing 22, the eccentric rotary member 3 being rotatably mounted in a case 4 through bearings 23. A gear 14 is arranged or cut in the forward end of an output shaft 13 of the hydraulic motor 2 and the gear 14 meshes with a gear 15 which is fixedly mounted on the end face of the eccentric rotary member 3 in alignment with the eccentric hole 21. The hydraulic motor 2 is fixedly mounted on the pipe shaft 1 and its housing is formed with a fluid flow passage 11 which is branched and communicates with the pipe shaft 1. The fluid flow passage 11 communicates with a fluid inlet 12 of the hydraulic motor 2. A nozzle 5 is fitted on one end of the pipe shaft 1 whose other end is connected to a flexible tube, more particularly superhigh pressure resisting hose 7 connected to a pump 6 forming a superhigh pressure producer.

In operation, the superhigh pressure water produced by the pump 6 is forced into the pipe shaft 1 through the hose 7 and is discharged from the nozzle 5. A part of the water forced into the pipe shaft 1 is branched from a portion of the pipe shaft 1 into the fluid flow passage 11 by which the fluid is supplied to the fluid inlet 12 of the hydraulic motor 2 and the energy of the superhigh pressure water is used for rotating the hydraulic motor 2. When the hydraulic motor 2 is rotated by the superhigh pressure water, its turning force is delivered to the output shaft 13. The output shaft 13 is provided with the gear 14 and thus rotates the eccentric rotary member 3 through its gear 15 which is meshed with the gear 14.

It is to be noted that the gear 15 on the eccentric rotary member 3 is arranged to rotate about the central axis of the eccentric hole 21 provided at the position which is eccentric by the distance e with the center of rotation R of the eccentric rotary member 3. Thus, coupled with the fact that the hydraulic motor 2 is fixedly mounted on the pipe shaft 1 and the distance between the center of the pipe shaft 1 and the output shaft 13 of the hydraulic motor 2 is constant, the gears 14 and 15 are always held in mesh with each other.

When the electric rotary member 3 set in rotation in this way rotates in the case 4, the eccentric hole 21 formed in the eccentric rotary member 3 moves along the circumference of a radius e whose center is the center of rotation of the eccentric rotary member 3. In other words, the eccentric hole 21 makes a circular motion whose radius is e. Namely, the pipe shaft 1 extended through the eccentric hole 21 makes a circular motion (precession) of the radius e whose center is the center of rotation of the eccentric rotary member 3 in the same manner as the eccentric hole 21. Of course, the hydraulic motor 2 is fixedly mounted on the pipe shaft 1 and therefore it moves circularly along with the rotation of the pipe shaft 1. However, since the pipe shaft 1 and the eccentric rotary member 3 are rotatably associated by the bearing 22, to be exact the pipe shaft 1 orbits about the center of rotation R of the eccentric rotary member 3 within the case 4 without rotating on its axis. The orbital motion of the pipe shaft 1 results in an orbital motion of the nozzle 5 fitted on the end of the pipe shaft 1 and the water discharged from the nozzle 5 describes a circular jet path.

The details of the preferred embodiment will now be described hereunder. The driving means 2 is preferably comprised of a hydraulically operated-type turbine motor. More specifically, as shown in the sectional view of FIG. 4, the driving means 2 includes a motor body 10 fixedly mounted on the pipe shaft 1, a turbine 35 rotatably mounted in bearings 24 and received in the motor body 10, and the output shaft 13 arranged to extend along the central axis of the turbine 35 and having the gear 14 cut in the forward end thereof. The fluid flow passage 11 is formed in the motor body 10 for conducting the water which is branched from the pipe shaft 1 and discharged against the turbine 35. A second nozzle 32 is attached to the fluid flow passage 11 at a given position nearest to the turbine 35 so as to open to the turbine 35 and discharge the high pressure water stream against the turbine 35, and a first nozzle 31 is arranged at a given position upstream of the second nozzle 32. An air-fluid mixing chamber 33 is arranged between the first and second nozzles 31 and 32 such that air is mixed into the water stream by the injection action produced by the high-velocity jet of water stream from the first nozzle 31 and the air-fluid mixing chamber 33 is communicates with the outside through vent holes 34.

With the hydraulic motor 2 constructed as described, the high pressure water branched from the pipe shaft 1 is introduced into the first nozzle 31 through the fluid flow passage 11 and is discharged from the first nozzle 31 toward the air-fluid mixing chamber 33, more exactly toward the second nozzle 32 which is formed to gradually flare in the upstream direction. When this occurs, due to the general principle an ejector or injection pump, the fluid existing around the streamline flow (in this case the outside air from the vent holes 34) is entrained onto the water stream supplied to the second nozzle 32 so that when the water stream is discharged from the second nozzle 32, the fluid (water) discharged from the first nozzle 31 and the fluid (air) entrained from the outside are mixed and discharged against the turbine 35.

Figure 4:
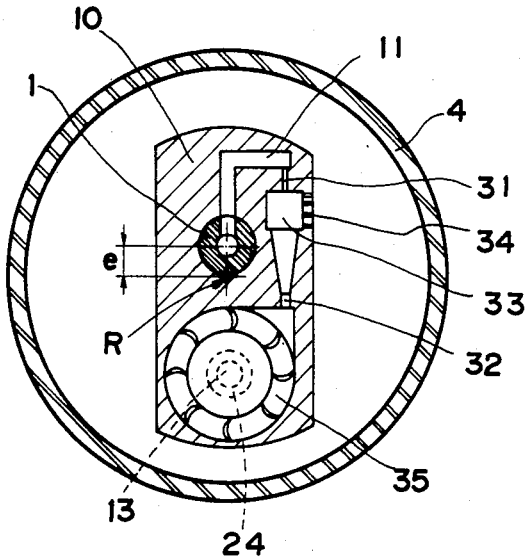
FIG. 4 shows an embodiment of the section taken along the line C—C of FIG. 1.
Figure 5:
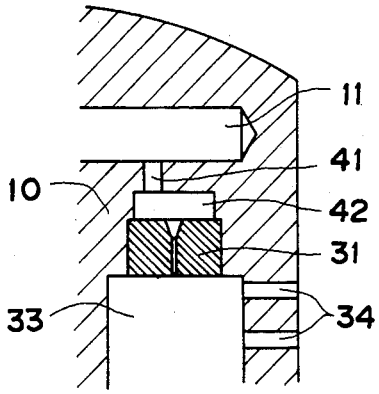
FIG. 5 shows another embodiment of the section shown in FIG. 4.

FIG. 5 shows a modification which differs from the embodiment of FIG. 4 in that an agitating nozzle 41 is further arranged immediately upstream of the first nozzle 31 so as to agitate the flow of water supplied to the first nozzle 31 from the fluid flow passage 11 and an agitating chamber 42 is arranged between the agitating nozzle 41 and the first nozzle 31, thereby further facilitating the mixing of air by the second nozzle 32 in the embodiment of FIG. 4.

Figure 6:
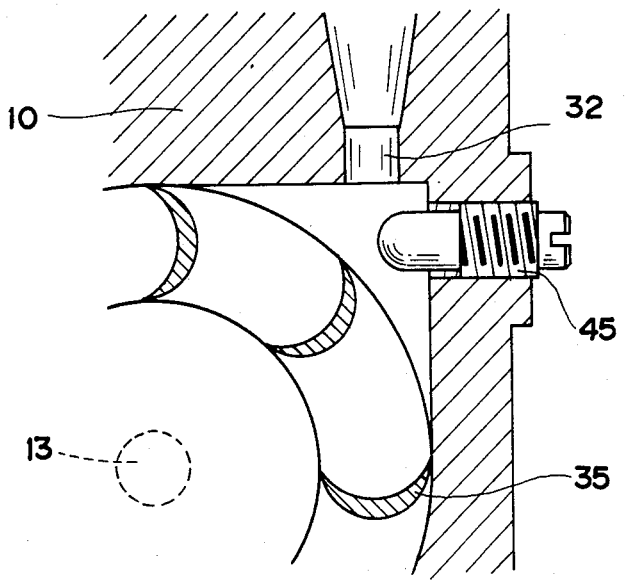
FIG. 6 shows another embodiment of the section shown in FIG. 4.

FIG. 6 shows an embodiment of means for controlling the rotation speed of the turbine 35, and this embodiment deflects the direction of the streamline flow of the air-fluid mixture discharged against the turbine 35 from the second nozzle 32 to control the angle at which the streamline flow impinges on the turbine 35 and thereby to adjust and control the speed of the turbine 35. Another methods of controlling the speed of the turbine 35 accomplish this purpose by adjusting the pressure or flow rate of the fluid discharged against the turbine 35.

I claim:

1. A superhigh pressure fluid injection apparatus comprising:

A pipe shaft (1) having first and second ends, wherein a nozzle (5) is mounted on the first end thereof and a superhigh pressure producer is mounted at the second end thereof;

rotating driving means (2) adapted to be actuated by a pressurized fluid produced by said superhigh pressure producer;

a rotary member (3) adapted to be driven into rotation by said driving means (2), said rotary member relatively rotatably supporting said pipe shaft at a position eccentric with the center of rotation thereof by a given distance (e), wherein upon rotation of said rotary member said nozzle is rotated to make a circular motion having a radius of gyration corresponding to the eccentricity (e) of said pipe shaft; and flow passage means (11) branched from said pipe shaft at a given position thereof to introduce the pressurized fluid into said driving means, wherein said driving means is fixedly mounted on said pipe shaft and rotates and drives said eccentric rotary member by making a planetary motion about said pipe shaft.

2. An apparatus according to claim 1, wherein said driving means (2) comprises:

a first nozzle (31) whereby the pressurized fluid branched from said pipe shaft (1) is discharged within said fluid flow passage means (11) before entering said first nozzle;

an air-fluid mixing chamber (33) for mixing air with said fluid discharged from said first nozzle at a position downstream of said first nozzle;

a second nozzle (32) arranged downstream of said air-fluid mixing chamber to converge and discharge said air-mixed fluid; and a turbine (35) rotatably arranged in opposition to said fluid discharged from said second nozzle.

3. An apparatus according to claim 2, wherein a means (41) is arranged in said fluid flow passage means (11) to agitate the flow of fluid supplied to said driving means (2).

4. An apparatus according to claim 1, wherein said driving means (2) includes means for adjusting the rotation speed of said turbine (35).

* * * * *